US009387502B2

(12) United States Patent
McKinzie

(10) Patent No.: US 9,387,502 B2
(45) Date of Patent: Jul. 12, 2016

(54) SCHEDULE ADVANCE FOR PUMP MOTOR CONTROLLER

(71) Applicant: Regal Beloit America, Inc., Beloit, WI (US)

(72) Inventor: Marc C. McKinzie, West Milton, OH (US)

(73) Assignee: Regal Beloit America, Inc., Beloit, WI (US)

( * ) Notice: Subject to any disclaimer, the term of this patent is extended or adjusted under 35 U.S.C. 154(b) by 524 days.

(21) Appl. No.: 13/832,250

(22) Filed: Mar. 15, 2013

(65) Prior Publication Data

US 2014/0277774 A1 Sep. 18, 2014

(51) Int. Cl.

| | |
|---|---|
| ***B05B 12/02*** | (2006.01) |
| ***F04B 49/06*** | (2006.01) |
| ***F04D 15/02*** | (2006.01) |

(52) U.S. Cl.

CPC ..... *B05B 12/02* (2013.01); *F04B 49/065* (2013.01); *F04D 15/0281* (2013.01); *Y10T 137/86389* (2015.04)

(58) Field of Classification Search

CPC ..... A01G 25/16; A01G 27/00; A01G 27/02; A01G 25/165; G05B 11/01

USPC ..... 700/11, 12, 14–17, 275, 282–284; 239/63, 67, 69, 70; 137/624.11–624.15, 624.18–624.2; 417/1, 2, 12, 26, 27; 236/46 R

See application file for complete search history.

(56) References Cited

U.S. PATENT DOCUMENTS

| | | | | |
|---|---|---|---|---|
| 4,646,224 | A * | 2/1987 | Ransburg et al. | 700/14 |
| 4,718,403 | A * | 1/1988 | McCall | 126/586 |
| 5,217,478 | A | 6/1993 | Rexroth | |
| 5,220,478 | A | 6/1993 | Innes et al. | |
| 5,269,794 | A | 12/1993 | Rexroth | |
| 5,343,590 | A | 9/1994 | Radabaugh | |
| 5,392,618 | A * | 2/1995 | Livingston et al. | 68/12.02 |
| 5,454,510 | A * | 10/1995 | Manson et al. | 236/46 R |
| 5,921,280 | A * | 7/1999 | Ericksen et al. | 137/624.11 |
| 5,949,346 | A | 9/1999 | Suzuki et al. | |
| 6,345,470 | B1 * | 2/2002 | Slaght et al. | 47/79 |
| 7,334,510 | B2 | 2/2008 | Gerdes et al. | |
| 7,351,274 | B2 | 4/2008 | Helt et al. | |

(Continued)

FOREIGN PATENT DOCUMENTS

| | | |
|---|---|---|
| CN | 102115229 | 7/2011 |
| GB | 2301894 | 12/1996 |

(Continued)

*Primary Examiner* — Crystal J Barnes-Bullock

(74) *Attorney, Agent, or Firm* — Michael Best & Friedrich LLP

(57) ABSTRACT

Methods and systems of controlling the operation of a pump according to a pump operation schedule are described. In one constructions, a pump controller enters a programming mode and monitors a number of inputs received through a user interface while in the programming mode. The programming mode is then exited and a delay time is defined equal to one hour for each input received through the user interface while in the programming mode. A stored pump operation schedule is accessed and operation of the pump is initiated according to the pump operation schedule after a period of time equal to the delay time has elapsed since exiting the programming mode. Operation of the pump is again initiated according to the accessed pump operation schedule every twenty-four hours since the pump operation schedule was last initiated.

14 Claims, 4 Drawing Sheets

(56) References Cited

U.S. PATENT DOCUMENTS

| | | | | |
|---|---|---|---|---|
| 7,536,936 | B2 | 5/2009 | Gerdes et al. | |
| 7,640,832 | B2 | 1/2010 | Gerdes et al. | |
| 7,681,478 | B2 | 3/2010 | Gerdes et al. | |
| 8,046,185 | B1 | 10/2011 | Chui | |
| 8,117,703 | B2 * | 2/2012 | Walker et al. | 8/158 |
| 8,188,876 | B1 | 5/2012 | Holley et al. | |
| 8,793,024 | B1 * | 7/2014 | Woytowitz et al. | 700/284 |
| 2005/0016338 | A1 | 1/2005 | Gerdes et al. | |
| 2005/0022639 | A1 | 2/2005 | Gerdes et al. | |
| 2007/0039462 | A1 | 2/2007 | Helt et al. | |
| 2008/0016996 | A1 | 1/2008 | Gerdes et al. | |
| 2008/0121076 | A1 | 5/2008 | Gerdes et al. | |
| 2011/0087390 | A1 | 4/2011 | Pandit et al. | |
| 2012/0042667 | A1 | 2/2012 | Fulmer et al. | |
| 2012/0157253 | A1 | 6/2012 | Hoff | |

FOREIGN PATENT DOCUMENTS

| | | |
|---|---|---|
| WO | 2007021854 | 2/2007 |
| WO | 2010107536 | 9/2010 |
| WO | 2011039771 | 4/2011 |
| WO | 2012087563 | 6/2012 |

* cited by examiner

SCHEDULE ADVANCE FOR PUMP MOTOR CONTROLLER

BACKGROUND

The invention relates to systems and methods for controlling the operation of a pump configured to pump fluid such as, for example, in a pool or spa.

SUMMARY

Pumping systems are integrated into a variety of applications to move a fluid through a system. For example, a pump system can be used in a pool to pump water through a filter to maintain the appropriate sanitation level in the water. However, to preserve energy, the pump is not operated at all times. A pump controller can be used to activate the pump at a desired speed for a defined duration of time. Some pump controllers can be programmed to begin operation of the pump at a defined time each day and to continue to run the pump for a defined duration. Some such pump controllers can be programmed with more advanced operation schedules where the pump is activated at a defined time each day and operated at a first defined speed for a defined duration. The pump is then operated at a second defined speed for a second duration.

Such pump controllers often include a graphic display and a real-time clock that allow a user to select the time of day that the pump is to begin operation and to define other operating parameters such as pump speed and the duration of operation. However, such user interfaces are relatively expensive and add to the complexity of the pump controller system. Furthermore, because a pump system is often allowed to operate according to the programmed schedule without further user input, the complex user interface is rarely used.

The systems and methods described herein enable a user to program a start time for a scheduled operation of a pump system without the use of an advanced display or a real-time clock (i.e., a clock programmed with the actual time of day). Instead, the system uses a simplified interface to allow the user to define a delay time or advance time and to start the scheduled operation of the pump after the prescribed time has passed. The pump controller will then continue to begin operation of the pump every 24 hours thereby initiating the pump operation at the same time each day.

In one embodiment, the invention provides a method of controlling the operation of a pump, the method comprising entering a programming mode and monitoring a number of inputs received through a user interface while in the programming mode. A delay time is defined based on the monitored number of inputs. A stored pump operation schedule is accessed and operation of the pump is initiated according to the pump operation schedule based on the defined delay time. Operation of the pump is again initiated according to the accessed pump operation schedule after a defined schedule repeat period has elapsed since the pump operation schedule was last initiated. In some embodiments, the defined schedule repeat period is 24-hours.

In another embodiment the invention provides a pump controlling including a user interface, a processor, and a memory. The memory stores instructions that are executed by the processor to control the operation of a pump. When executed, the instructions cause the pump controller to enter a programming mode and monitor a number of inputs received through the user interface while in the programming mode. A delay time is defined based on the monitored number of inputs. A stored pump operation schedule is accessed and operation of the pump is initiated according to the pump operation schedule based on the defined delay time. Operation of the pump is again initiated according to the accessed pump operation schedule after a defined schedule repeat period has elapsed since the pump operation schedule was last initiated. In some embodiments, the defined schedule repeat period is 24-hours.

In still another embodiment, the invention provides a method of controlling the operation of a pump. A pump controller enters a programming mode and monitors a number of inputs received through a user interface while in the programming mode. The programming mode is then exited and a delay time is defined equal to one or two hours for each input received through the user interface while in the programming mode. A stored pump operation schedule is accessed and operation of the pump is initiated according to the pump operation schedule after a period of time equal to the delay time has elapsed since exiting the programming mode. Operation of the pump is again initiated according to the accessed pump operation schedule every twenty-four hours since the pump operation schedule was last initiated.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
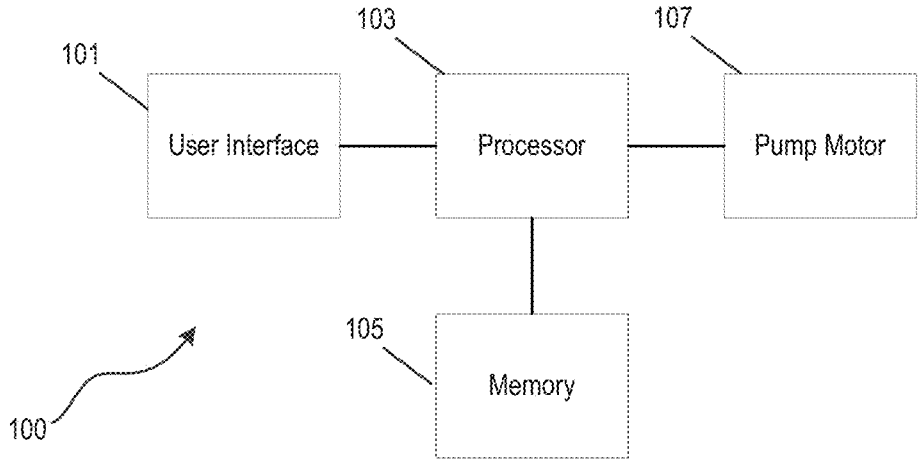
FIG. 1 is a block diagram of a pump system according to one embodiment.

FIG. 1 illustrates a system 100 for controlling the operation of a fluid pump of the type used in pools and spas. However, the system 100 could be used in various other pumping applications. The system includes a user interface 101 which provides an input to a processor 103. The processor 103 executes instructions stored on a memory 105 to control the operation of a pump motor 107. The memory 105 also stores information regarding the operating parameters of the pump system 100 including, for example, a duration of operation and a speed of operation. In alternatively constructions, the processor 103 and memory 105 may be replaced with an application specific integrated circuit (ASIC) or other control system.

In some constructions, the processor and memory are incorporated into a pump controller. The pump controller includes combinations of software and hardware. In one construction, the controller includes a printed circuit board ("PCB") that is populated with a plurality of electrical and electronic components that provide power, operational control, and protection to the pump system 100. In some constructions, the PCB includes, for example, the processor 103 (e.g., a microprocessor, a microcontroller, or another suitable programmable device or combination of programmable devices), the memory 105, and a bus. The bus connects various components of the PCB, including the memory 105, to the processor 103. The memory 105 includes, for example, a read-only memory ("ROM"), a random access memory ("RAM"), and electrically erasable programmable read-only memory ("EEPROM"), a flash memory, a hard disk, or another suitable magnetic, optical, physical, or electronic memory device. Additionally or alternatively, the memory 105 and the processor 103 are included in the same microcontroller. The controller also includes an input/output ("I/O") system that includes routines for transferring information between components within the controller and other components of the pump system 100. For example, the I/O system communicates with the user interface 101 and the pump motor 107.

As noted above, software included in the implementation of the pump system 100 is stored in the memory 105 of the controller. The software includes, for example, firmware, one or more applications, program data, one or more program modules, and other executable instructions. The controller is configured to retrieve from memory and execute, among other things, instructions related to the control processes and methods described herein.

The PCB also includes, among other things, a plurality of additional passive and active components such as resistors, capacitors, inductors, integrated circuits, converters, and amplifiers. These components are arranged and connected to provide a plurality of electrical functions to the PCB including, among other things, filtering, signal conditioning, signal converting, or voltage regulation. For descriptive purposes, the PCB and the electrical components populated on the PCB are collectively referred to herein as the controller or the pump controller.

Before proceeding further, it should be understood that various adjectives or identifiers, such as START, STOP, UP, and DOWN, are used throughout the description. The terms are used to better identify an operation of the pump controller corresponding to various buttons of the user interface. It should be understood to someone skilled in the art that various synonyms can be used to in place of the identifiers used herein. Furthermore, components of the user interface identified in this description as "buttons" can be implemented by a variety of hardware push-buttons, switches, sliders, etc. The buttons could also be implemented, for example, as virtual buttons on an LCD touchscreen display.

Figure 2:
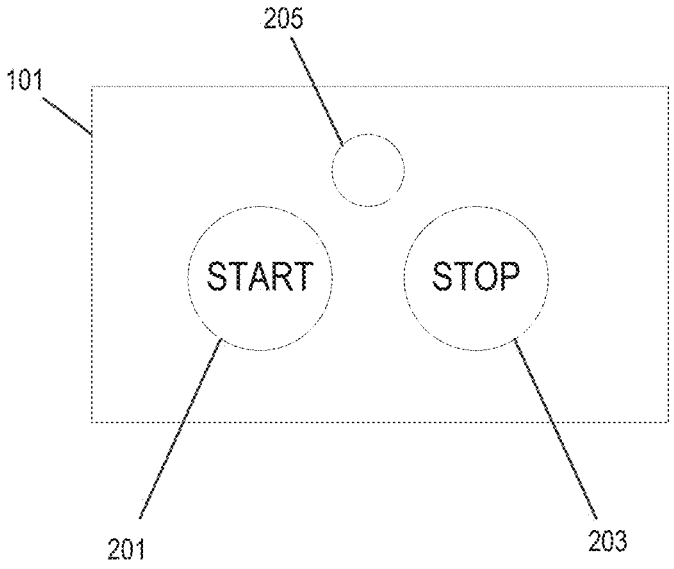
FIG. 2 is a front view of a user interface of the pump system of FIG. 1.

FIG. 2 illustrates an example of a user interface 101 through which a user can provide information and instructions that are used by the processor 103 to control the operation of the pump motor 107. The user interface 101 includes a START button 201, a STOP button 203, and an LED indicator 205. As described in detail below, the processor 103 is configured to automatically control the operation of the pump motor 107 according to a pump schedule stored on the memory 105. However, a user can manually override the pump schedule by pressing the START button 201 to start the operation of the pump motor and by pressing the STOP button 203 to stop the operation of the pump motor. The LED indicator 205 in this example is lit when the pump motor 107 is operating and is not lit when the pump motor 107 is not operating. However, in other constructions, the LED indicator 205 can be replaced by another display element such as, for example, a multicolored LED indicator that is lit in green when the pump motor 107 is operating and lit in red when the pump motor 107 is not operating.

The memory 105 is programmed with a pump schedule that is periodically run by the processor 103 to automatically control the operation of the pump. For example, the pump schedule can indicate that the pump motor 107 is to be run for a defined period of time (e.g., 45 minutes) once each day. Based on this pump schedule, the processor 103 activates the pump for 45 minutes every 24 hours. In some constructions that include a variable speed motor, the pump schedule also indicates a speed at which the pump is to be operated during the 45 minute period every 24 hours.

The complexity of the programmed pump schedule varies depending upon the constructions. In some constructions, the entire 24-hour period is accounted for. For example, the pump schedule can start by running at a first speed for 6 hours, then remain turned off for 6 hours, then operate at a reduced speed for 6 hours, and then remain turned off for 6 hours before beginning the schedule again. In some constructions, the programming schedule can be based on a period longer than 24-hours. For example, the pump schedule can define different operational parameters for the pump for each day of the week.

The pump schedule can be stored on the memory 105 by a variety of mechanisms including, for example, storing a predefined program schedule to the memory 105 at the time of manufacture, creating a pump schedule through an external device connected to the processor (e.g., a technician's service device or a personal computer), or can be programmed by the user through the user interface 101.

To simplify the pump controller system 100, specifically the user interface 101, the pump control system 100 does not include a real-time clock and, as such, has no knowledge of the actual time of day. Therefore, the user cannot adjust the start time of the pump schedule by entering a scheduled start time (e.g., 6:00 AM). Instead, the pump controller system 100 is programmed with a schedule advance feature that allows the user to set a start time for the pump schedule relative to the current time.

Figure 3:
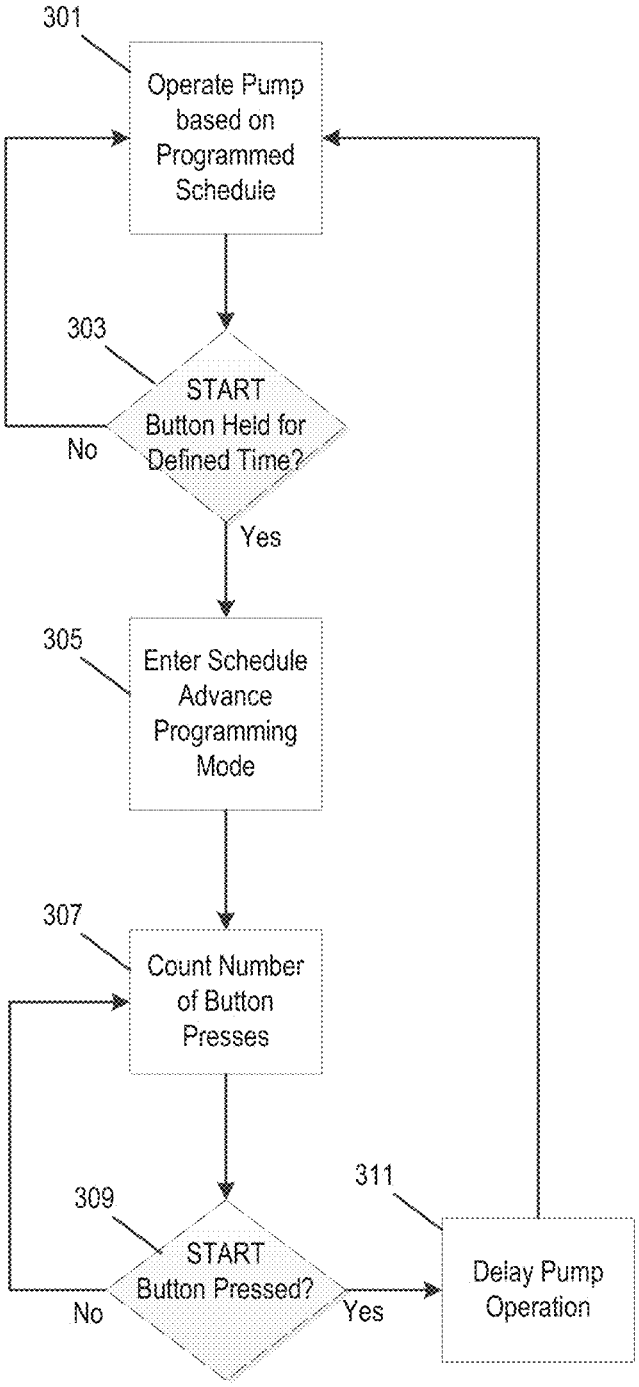
FIG. 3 is a flowchart of a method of setting a start time of a programmed pump operation schedule using the user interface of FIG. 2.

FIG. 3 illustrates an example of how the control system 101 adjusts the start time of the pump schedule based on the schedule advance feature by receiving user inputs through the user interface 101 of FIG. 2. The pump controller 101 begins by operating the pump based on the programmed pump schedule (step 301). When the pump controller 101 determines that the user has held the START button 201 for a defined period of time (step 303), the controller 101 enters a "Schedule Advance" programming mode (step 305). The pump controller 101 indicates that it has entered the programming mode by causing the LED indicator 205 to blink. While in the programming mode, the user defines a delay time by pressing the STOP button 203 a number of times corresponding to a number of hours. The pump controller 101 counts the number of times the STOP button 203 has been pressed during the programming mode (step 307). When the user again presses the START button 201 (step 309), the pump controller 101 exits the programming mode. The pump controller 101 then waits for the delay period (corresponding to the number of times that the STOP button 203 was pressed during the programming mode) to elapse (step 311) and then begins operation of the programmed pump schedule (step 301).

To further illustrate the method of FIG. 3, consider a user that wants to configure the pump system to begin operation according to the programmed pump schedule at 6:00 AM. At 7:00 PM, the user holds the START button 201 and enters the "schedule advance" programming mode. The user presses the STOP button 203 eleven times before pressing the START button 203 again. By pressing the STOP button 203 eleven times, the user has defined the delay period as eleven hours. The pump controller 101 waits for the delay period to pass and begins operating the pump according to the pump schedule at 6:00 AM the next morning.

In other constructions, the mechanism for entering the schedule advance mode and defining the delay period can vary. For example, using the interface of FIG. 2 (or a similar interface that only includes a single START button), a user could enter the "schedule advance" programming mode by holding the START button for a defined time period until the LED starts blinking. However, in such alternative constructions, the user could define the delay period by pressing the START button a number of times before holding the START button until the LED stops blinking (i.e., the programming mode has been terminated).

Furthermore, in some constructions, the delay time defined during the programming mode does not define a start time for the pump schedule relative to the time that the programming mode is utilized. Instead, the currently scheduled start time of the pump schedule operation is adjusted based on the number of times that the STOP button 203 is pressed. For example, if the pump system is currently configured to begin operation of the pump schedule at 6:00 AM each morning, the user can enter the programming mode and press the STOP button 203 six times. This would adjust the start time of the pump schedule such that the pump schedule is initiated six hours later each than currently scheduled (i.e., 12:00 PM).

Additionally, in some constructions, the user can define the delay time in both positive and negative directions. For example, once in the programming mode, the user can press the STOP button 203 to add an hour to the delay time and press the START button 201 to subtract an hour to the delay time. As such, if the user accidentally hits the STOP button once too many times, the user can correct their error. Furthermore, the user can define a negative delay time. For example, if the user presses the START button 201 three times at 6:00 AM, the delay time is defined by the controller 101 as −3 hours. The controller determines this delay time to indicate that the user intends for operation of the pump schedule to occur daily at a time three hours earlier. As such, the controller waits 21 hours and begins executing the pump schedule at 3:00 AM each day.

Similarly, in some constructions where the programming mode indicates an adjustment to the currently scheduled start time, the user is able to adjust the currently scheduled start time in both the positive and negative direction. For example, if the controller 101 is currently configured to being operation according to the pump schedule at 6:00 AM each day and the user presses the START button 201 three times during the programming mode, the controller 101 interprets this instruction as moving the start time back three hours each day. As such, the pump schedule is initiated at 3:00 AM the next day.

Some constructions of the controller are configured to allow the user to define a delay time as illustrated in FIG. 3 and to adjust an already programmed start time. For example, the controller 101 could enter a first programming mode when the START button 201 has been held for the defined time period a first time. During the first programming mode, the user can define a delay time that is used to set a start time relative to the current time. When the user holds the START button 201 for the defined time period for a second time, the controller 101 enters a second programming mode where the user can adjust the currently programmed start time. Alternatively the controller 101 can be programmed to enter the first programming mode when the START button 201 is held for the defined period of time and to enter the second programming mode when the STOP button 203 is held for the defined period of time.

Lastly, although the examples described above define the delay time (or adjust the start time) based on one-hour for each time a button has been pressed during the programming mode, in some constructions, the time period assigned to a single button push can be defined differently. For example, in some constructions a single button press corresponds to a one-minute interval while in other constructions a single button press corresponds to a half hour.

Figure 4:
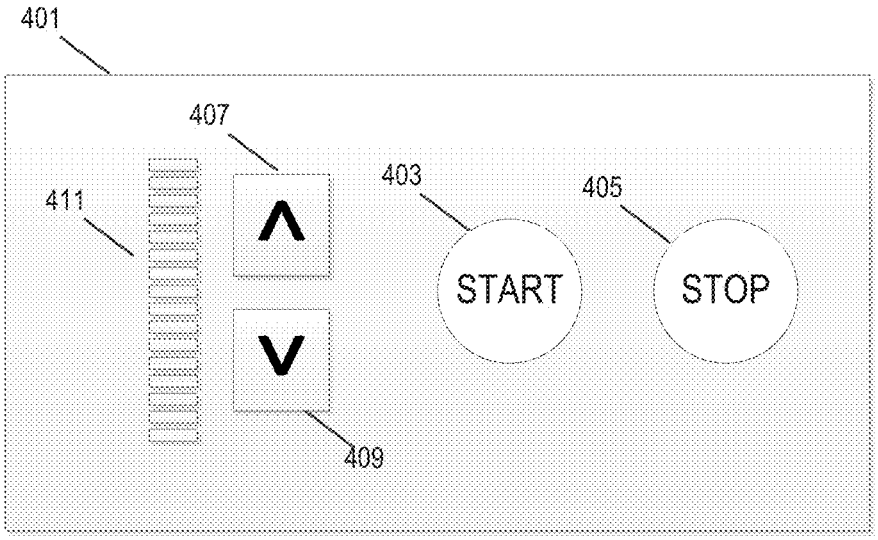
FIG. 4 is a front view of an alternative user interface for the pump system of FIG. 1.

The schedule advance functionality described above can also be implemented in systems with a more advanced user interface. For example, FIG. 4 illustrates a user interface 401 including a START button 403, a STOP button 405, an UP button 407, and a DOWN button 409. The user interface 401 also includes a segmented LED bar-graph display 411. The controller 101 can be programmed to take advantage of the more advanced user interface elements in this example. The user again enters the "schedule advance" programming mode by holding the START button 403 for a defined period of time. However, the user defines the delay period (or adjusts the currently programmed start time) using the UP button 407 and the DOWN button 409. Furthermore, the bar graph display 411 can indicate the current value of the delay period by lighting (or blinking) a number of segments.

Figure 5:
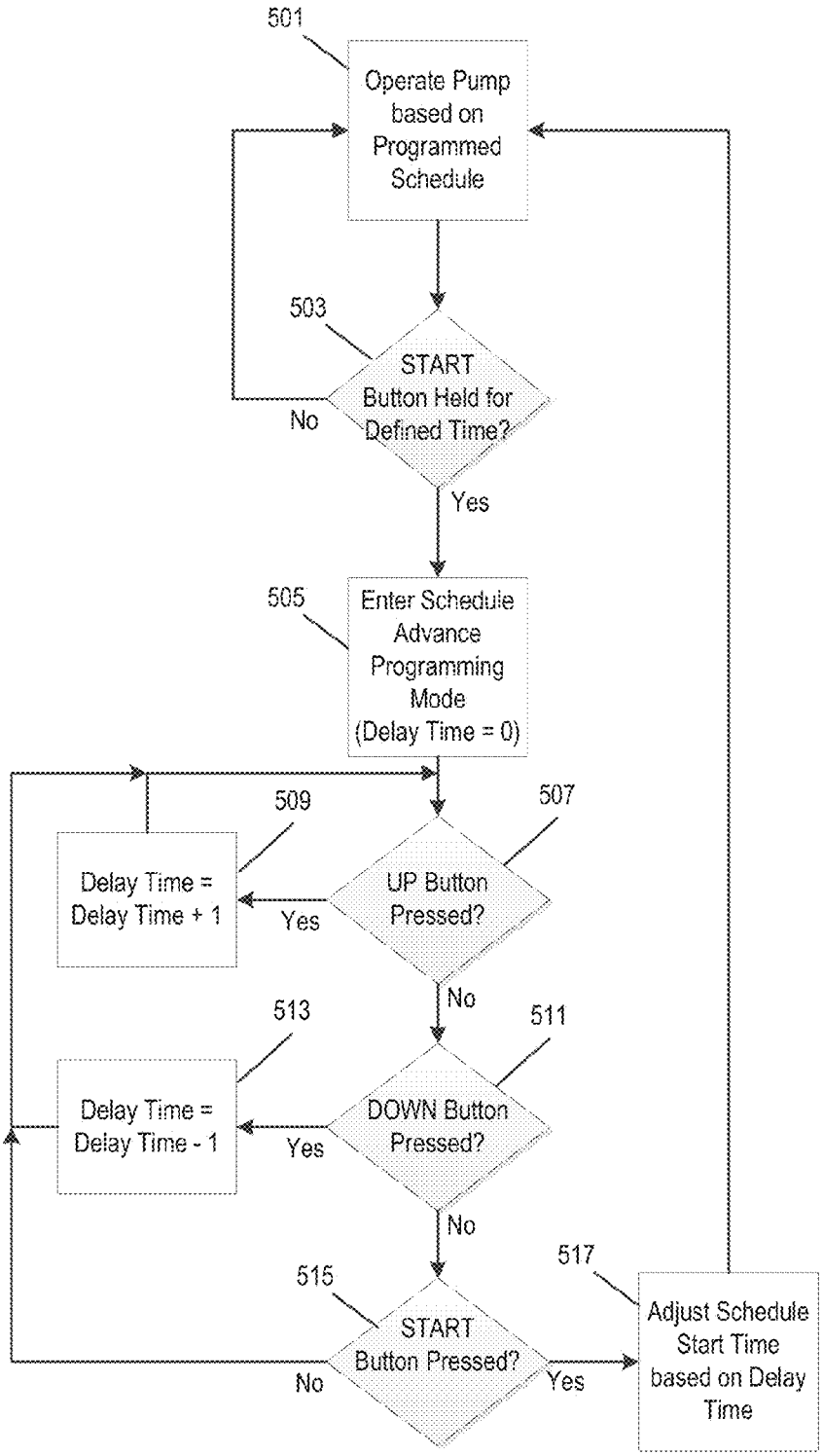
FIG. 5 is a flowchart of a method of setting a start time of a programmed pump operation schedule using the user interface of FIG. 4.

FIG. 5 illustrates one example of the operation of pump controller using the user interface 401 of FIG. 4. The pump controller begins by operating the pump based on the programmed schedule (step 501). The pump controller monitors the buttons of the interface. It detects when the START button 403 has been held for a defined period of time (step 503) and then enters the schedule advance programming mode (step 505). At the beginning of the programming mode, the delay time variable is set equal to zero.

While in the programming mode, the pump controller continues to monitor the buttons on the user interface 401. When the UP button 407 is pressed (step 507), the delay time is increased by one (step 509). When the DOWN button 409 is pressed (step 511), the delay time is decreased by one (step 513). As noted above, the LED bar graph 411 can be used to indicate the value of the delay time as set by the user during the programming mode. When the START button 403 is pressed a second time (step 515), the controller exits the programming mode and adjusts the start time for the pump schedule based on the defined delay time (step 517). As discussed above in various constructions, the "delay time" defined during the programming mode can be used to set a relative start time for the pump schedule (e.g., a delay time=5 means that the pump schedule will begin in five hours) or it can be used to adjust the currently defined start time for the pump schedule (e.g., a delay time=5 moves the start time back five hours from its current scheduled start time).

Thus, the invention provides, among other things, a method and system for adjusting the start time of a programmed pump operation schedule using relative time adjustments. Various features and advantages of the invention are set forth in the following claims.

What is claimed is:

1. A method of controlling the operation of a pump, the method comprising:

entering a programming mode;

monitoring a number of inputs received through a user interface while in the programming mode;

defining a delay time based on the monitored number of inputs;

accessing a stored pump operation schedule;

initiating operation of the pump according to the accessed pump operation schedule based on the defined delay time;

initiating operation of the pump according to the accessed pump operation schedule after a defined schedule repeat period has elapsed since the pump operation schedule was last initiated;

wherein the act of monitoring a number of inputs received through a user interface while in the programming mode includes monitoring a number of times that a first button is pressed and a number of times that a second button is pressed; and wherein the act of defining a delay time based on the monitored number of inputs includes adding one hour to the delay time for each time that the first button is pressed and subtracting one hour from the delay time for each time that the second button is pressed.

2. The method of claim 1, wherein the act of defining a delay time based on the monitored number of inputs includes defining the delay time as equal to one hour for each input received through the user interface while in the programming mode.

3. The method of claim 1, wherein the act of initiating operation of the pump according to the accessed pump operation schedule based on the defined delay time includes initiating the operation of the pump according to the accessed pump operation schedule after a period of time equal to the delay time has elapsed since exiting the programming mode.

4. The method of claim 1, wherein the act of initiating operation of the pump according to the accessed pump operation schedule after a defined schedule repeat period has elapsed since the pump operation schedule was last initiated includes initiating operation of the pump according to the accessed pump operation schedule after a period of twenty-four hours has elapsed since the pump operation schedule was last initiated.

5. The method of claim 1, wherein, when the defined delay time is less than zero, the act of initiating operation of the pump according to the accessed pump operation schedule based on the defined delay time includes adding the defined delay time to the defined schedule repeat period; and initiating the operation of the pump according to the accessed pump operation schedule after a period of time equal to a sum of the defined delay time and the defined schedule repeat period has elapsed since exiting the programming mode.

6. The method of claim 1, further comprising monitoring an amount of time that a button of the user interface is held, and wherein the act of entering the programming mode includes entering the programming mode when the button of the user interface has been held for longer than a defined period of time.

7. The method of claim 1, further comprising tracking an amount of time remaining until the pump operation schedule is to be initiated next based on an elapsed amount of time since the pump operation schedule was last initiated, and wherein the act of initiating operation of the pump according to the accessed pump operation schedule based on the defined delay time includes adding one hour to the amount of time remaining until the pump operation schedule is to be initiated next for each input received through a user interface while in the programming mode.

8. A pump controller including a user interface, a processor, and a memory storing instructions that, when executed by the processor, cause the pump controller to:

enter a programming mode;

monitor a number of inputs received through the user interface while in the programming mode;

define a delay time based on the monitored number of inputs;

access a pump operation schedule stored on the memory;

initiate operation of the pump according to the accessed pump operation schedule based on the defined delay time;

initiate operation of the pump according to the accessed pump operation schedule after a defined schedule repeat period has elapsed since the pump operation schedule was last initiated;

wherein the user interface includes a first button and a second button; and wherein the instructions, when executed by the processor, further cause the pump controller to monitor a number of inputs received through a user interface while in the programming mode by monitoring a number of times that the first button of the user interface is pressed and the number of times that a second button of the user interface is pressed, and cause the pump controller to define a delay time based on the monitored number of inputs by adding one hour to the delay time for each time that the first button is pressed and subtracting one hour from the delay time for each time that the second button is pressed.

9. The pump controller of claim 8, wherein the instructions, when executed by the processor, cause the pump controller to define a delay time based on the monitored number of inputs by defining the delay time as equal to one hours for each input received through the user interface while in the programming mode.

10. The pump controller of claim 8, wherein the instructions, when executed by the processor, cause the pump controller to initiate operation of the pump according to the accessed pump operation schedule based on the defined delay time by initiating the operation of the pump according to the accessed pump operation schedule after a period of time equal to the delay time has elapse since exiting the programming mode.

11. The pump controller of claim 8, wherein the instructions, when executed by the processor, cause the pump controller to initiate operation of the pump according to the accessed pump operation schedule after a defined schedule repeat period has elapsed since the pump operation schedule was last initiated by initiating operation of the pump according to the accessed pump operation schedule after a period of twenty-four hours has elapsed since the pump operation schedule was last initiated.

12. The pump controller of claim 8, wherein, when the defined delay time is less than zero, the instructions, when executed by the processor, cause the pump controller to initiate operation of the pump according to the accessed pump operation schedule based on the defined delay time by adding the defined delay time to the defined schedule repeat period; and initiating the operation of the pump according to the accessed pump operation schedule after a period of time equal to a sum of the defined delay time and the defined schedule repeat period has elapsed since exiting the programming mode.

13. The pump controller of claim 8, wherein the instructions, when executed by the processor, further cause the pump controller to monitor an amount of time that a button of the user interface is held, and cause the pump controller to enter the programming mode when the button of the user interface has been held for longer than a defined period of time.

14. The pump controller of claim 8, wherein the instructions, when executed by the processor, further cause the pump controller to track an amount of time remaining until the pump operation schedule is to be initiated next based on an elapsed amount of time since the pump operation schedule was last initiated, and cause the pump controller to initiate operation of the pump according to the accessed pump operation schedule based on the defined delay time by adding one hour to the amount of time remaining until the pump operation schedule is to be initiated next for each input received through a user interface while in the programming mode.

* * * * *